United States Patent [19]

Trowbridge et al.

[11] Patent Number: 4,915,753

[45] Date of Patent: Apr. 10, 1990

[54] COATING OF BORON PARTICLES

[75] Inventors: John C. Trowbridge, Saratoga, Calif.; Jack D. Breazeal, Koloa, Hi.

[73] Assignee: United Technologies Corporation, Hartford, Conn.

[21] Appl. No.: 252,840

[22] Filed: Nov. 21, 1988

Related U.S. Application Data

[62] Division of Ser. No. 93,938, Sep. 8, 1987, abandoned.

[51] Int. Cl.[4] ..... C06B 45/30

[52] U.S. Cl. ..... 149/5; 149/22; 149/110; 149/114

[58] Field of Search ..... 149/5, 22, 110, 114

[56] References Cited

U.S. PATENT DOCUMENTS

| | | | |
|---|---|---|---|
| 4,499,156 | 2/1985 | Smith et al. | 428/614 |
| 4,733,816 | 3/1988 | Eylon et al. | 228/190 |
| 4,746,374 | 5/1988 | Froes et al. | 148/11.5 F |
| 4,807,798 | 2/1989 | Eylon et al. | 228/190 |
| 4,822,432 | 4/1989 | Eylon et al. | 148/127 |

*Primary Examiner*—Stephen J. Lechert, Jr.

[57] ABSTRACT

Method for coating boron particles with a thin ceramic layer. The method provides for thermal decomposition of a hydrocarbon gas in the presence of the boron particles. The coated particles are useful in fuels, giving improved combustion in solid propellant and ramjet fuels.

1 Claim, No Drawings

COATING OF BORON PARTICLES

This is a division of copending application Ser. No. 93,938 filed on Sept. 8, 1987, abandoned.

DESCRIPTION

1. Technical Field

This invention relates to rocket propellants and more particularly, to rocket propellants comprising boron.

2. Background Art

Combustion of metal particles is desirable in the utilization of propellants and fuels for rocket propulsion. Burning metals add significantly to the improved performance of various propellants and are widely used in solid propellants and ramjet fuels. An increase in efficiency of metal combustion translates to major gains in rocket system performance.

Many metals have been used in fuels. For example, aluminum, titanium and magnesium are metals which have commonly been used to increase performance in solid propellants and ramjet fuels in the past. However, metals differ in their energy release during combustion, making some metals a better choice than others in rocket systems.

Boron metal has not typically been used in the past because of its poor combustion performance relative to some of the more conventionally used metals. Boron metal is less efficient in its combustion than some other metals due to the nature of the oxide coating formed while heating the boron metal to its ignition temperature. The boron oxide formed is a low melting, viscous liquid during heating and initiates agglomeration of the individual boron particles. These large boron agglomerates are less efficient in their combustion than are the original small particles. However, boron gives a high energy release during combustion and would be preferred to other metals if a method could be found to stop the agglomeration of the boron particles.

Accordingly, there has been a continuing search in the art for a method to stop agglomeration of the boron particles producing a more efficient combustion.

DISCLOSURE OF THE INVENTION

A method for improving the combustion performance of boron by coating boron with a layer of ceramic boron carbide is disclosed. The ceramic coating protects the particle from oxidation and stops the agglomeration of the boron particles. The method provides for reacting boron with a low molecular weight alkane or low molecular weight alkene (e.g., methane) at reaction conditions sufficient to decompose the hydrocarbon without reacting or consuming all of the boron. The result is a coated boron particle which is oxidation resistant and more combustion efficient. The fuel comprising boron carbide coated boron particles is also disclosed.

Other features and advantages of the present invention will become apparent in light of the following description thereof.

BEST MODE FOR CARRYING OUT THE INVENTION

The boron is in solid particle form as free from boron oxide as possible. It is preferred to have the boron particles substantially free of boron oxide because the boron oxide has little fuel value in rockets and also initiates agglomeration of the boron particles. However, the boron coating reaction does produce excess hydrogen gas which reduces some of the boron oxide initially present, further enhancing the reaction's usefulness.

Boron powder is commercially available from Herman Stark Company with offices in West Germany and New York and it is also available from Atlantic Equipment Engineers, New Jersey and from Kerr McGee Chemical Corporation, Oklahoma. Any size boron particle could be used. Typically, the boron particles used in this invention have a mean particle size ranging from about 0.8 micron to about 1.2 microns.

It is believed metals other than boron could also be used in this invention. For example, any carbide forming metal such as aluminum or titanium. Also, it is possible that metal alloys, especially those alloys containing boron, could be used and benefit from protective coatings.

The hydrocarbon gas used in the practice of this invention may be any low molecular weight alkane or alkene (i.e., any alkane or alkene with fewer than five (5) carbon atoms per molecule). Higher temperatures are generally required to decompose higher order alkanes or alkenes. Methane is preferred for thermodynamic reasons and also because it gives a cleaner reaction product. For example, ethane and ethene not only require higher temperature to decompose than methane, but also leave more carbon behind than methane which typically decreases performance.

It is believed that gases other than alkanes or alkenes could be used in the practice of this invention to form different ceramic coatings such as silicides, nitrides, or phosphides. Other metals may also be used when practicing the invention with such other gases.

Typically, additives are not desirable because impurities in the final product generally decrease combustion performance of the coated particles.

The relative amounts of the hydrocarbon gas and boron metal may be varied. However, it is preferred to have a surplus of the alkane or alkene gas to assure coating of all the boron particles. The more important parameter is a ratio of the volume of the hydrocarbon gas to the surface area of the boron particles. It is preferred to have excess alkane or alkene in the reaction chamber in comparison to the surface area of the boron particles assuring a complete coating of all the boron particles. It is also preferred that only the boron at the surface reacts with the alkane or alkene to form a thin ceramic layer of boron carbide which protects the inner core of boron because the boron metal inner core will be used as the fuel. If all of the boron reacts with the hydrocarbon gas (not only the surface) then a particle of boron carbide will be formed which is not as useful for rocket fuel.

The reaction chamber may be a vessel of any size which is gas-tight, nonreactive and which will withstand the required heating process. A one liter Monel® metal alloy (Huntington Alloy Products Division, International Nickel Company, Inc.) cylinder commercially available from Hoke Manufacturing Company, Cresskill, N.J. works well in the invention.

The boron may be added before, during or after heating the alkane or alkene gas. Typically, the hydrocarbon gas is heated with the boron in a reaction chamber to a temperature sufficient to decompose the alkane or alkene without reacting with (consuming) all of the boron. Typically, the temperature is from about 650° C. to about 1100° C., but, of course, varies with the hydrocarbon used as well as time and pressure conditions used for the reaction. The heating is typically done over a period of about 8 hours to about 96 hours at about 0.8 atmosphere to about 1.2 atmospheres pressure. Preferably methane is heated at about 815° C. to about 820° C. for 16 hours at about 1 atmosphere pressure. At this temperature the boron is still in a solid form.

The boron carbide forms a ceramic coating on the surface of the boron particles. It is known that boron particles are somewhat porous. Therefore, it is not surprising that the thickness of the layer of boron carbide is difficult to measure. It is preferred to have a layer surrounding and encapsulating a boron particle which is as thin as possible while being resistant to oxidation so as to protect the boron particles from agglomeration. Typically, the coating thickness is less than 100 Å (angstroms) as shown by surface analysis by electron spectroscopy. (See tables 1 and 2). The coating thickness depends upon the reaction conditions. Generally, higher temperatures and longer times produce greater coating thickness.

EXAMPLE 100 grams of boron powder with a mean particle size of 1 micron was placed into a one liter Monel® metal cylinder. The air was then evacuated from the cylinder by vacuum. The remaining volume of the cylinder (about ⅔ of a liter) was filled with methane gas. The cylinder was then sealed with a tight plug and heated for about 16 hours at approximately 815° C. at about 1 atmosphere pressure.

TABLE 1

ESCA Results: Elemental composition data measure from the surface (approximately the top 100 Å) of each sample and expressed in atomic percent units for the elements detected.

| Sample Description | B | C | O |
|---|---|---|---|
| Boron Carbide Control | 51. | 28. | 19. |
| Unprocessed Boron | 58. | 24. | 12. |

TABLE 1-continued

ESCA Results: Elemental composition data measure from the surface (approximately the top 100 Å) of each sample and expressed in atomic percent units for the elements detected.

| Sample Description | B | C | O |
|---|---|---|---|
| Roasted Boron | 58. | 18. | 18. |

Table 1 shows results of ESCA (electron spectroscopy for chemical analysis) for boron, carbon and oxygen. Three boron powder samples were analyzed: Boron Carbide Control, a "pure" boron carbide sample; Unprocessed Boron, a "pure" boron sample—starting material for this invention; and Roasted Boron, a boron particle sample which has undergone the process of heating methane in the presence of the unprocessed boron as described herein. Table 1 shows all of the samples contain some boron, carbon and oxygen in varying amounts.

Table 2 clearly shows that the surface of the Roasted Boron has been coated with $B_4C$ (columns $C_1$ and $B_2$). In contrast the Unprocessed Boron sample has no $B_4C$ coating; the $B_2$ column for the Unprocessed Boron is due to boron hydrides exclusively. The Unprocessed Boron has carbon present as shown in Table 1, but as Table 2 shows that carbon is not present in the $B_4C$ form ($C_1$), rather the carbon is present as C—R, C—OR, and O=C—OR [columns $C_2$, $C_3$, $C_4$ in the table respectively].

TABLE 2

High Resolution ESCA Data: Binding energies, atom percentages and peak assignments. Binding energies were corrected to the binding energy of the C(1s) signal at 284.6 eV. Atom percentages were calculated from the high resolution data. Peak assignments were based on the binding energies of reference compounds. The symbol (—) indicates that no signal was detected for that element.

| Sample Description | $C_1$ | $C_2$ | $C_3$ | $C_4$ | $B_1$ | $B_2$ | $B_3$ | $B_4$ |
|---|---|---|---|---|---|---|---|---|
| Boron Carbide Control | | | | | | | | |
| Binding Energies (eV) | 282.2 | 284.6 | 285.9 | — | — | 187.8 | 189.2 | — |
| Atom Percent | 8.5 | 16. | 3.2 | — | — | 40. | 11. | — |
| Unprocessed Boron | | | | | | | | |
| binding Energies (eV) | — | 284.6 | 286.2 | 288.5 | 187.0 | 188.2 | — | — |
| Atom Percent | — | 17. | 4.7 | 1.9 | 36. | 22. | — | — |
| Roasted Boron | | | | | | | | |
| Binding Energies (eV) | 284.4 | 284.6 | 286.2 | — | — | 187.4 | 188.8 | 191.2 |
| Atom Percent | 3.2 | 10. | 3.6 | — | — | 34. | 16. | 7.8 |

$C_1 = B_4C$
$C_2 = C—R$ (R = C, H)
$C_3 = \overline{C}—OR$
$C_4 = \overline{O}=\underline{C}—OR$
$B_1 = B$
$B_2 = B_4C, B_xH_y$
$B_3 = BO_x$ (suboxide)
$B_4 = B_2O_3$ The boron carbide coated boron particles formed can be used in solid propellant or ramjet fuels. The ceramic boron carbide coating on the particles protects the boron metal and alleviates the agglomeration of boron particles. Therefore, it is believed that the critical thrust performance/weight ratio is improved using the present invention.

It should be understood that the invention is not limited to the particular embodiments shown and described herein, but that various changes and modifications may be made without departing from the spirit and scope of this novel concept as defined by the following claims.

We claim:

1. A solid propellant comprising about 0.8 micron to about 1.2 micron mean size boron particles having a boron carbide layer about 1 Å to about 100 Å thereon.

* * * * *

UNITED STATES PATENT AND TRADEMARK OFFICE

CERTIFICATE OF CORRECTION

PATENT NO. : 4,915,753

DATED : April 10, 1990

INVENTOR(S) : John C. Trowbridge, Jack D. Breazeale

It is certified that error appears in the above-identified patent and that said Letters Patent is hereby corrected as shown below:

TITLE PAGE:

(75) Inventors: delete "Breazeal" and insert --Breazeale--.

(62) delete "abandoned" and insert --now U.S. Patent No. 4,877,649, issued October 31, 1989--.

Column 1, line 5, delete "abandoned" and insert -- now U.S. Patent No. 4,877,649, issued October 31, 1989--.

Signed and Sealed this

Seventh Day of May, 1991

*Attest:*

HARRY F. MANBECK, JR.

*Attesting Officer*

*Commissioner of Patents and Trademarks*